US006705583B2

(12) United States Patent
Daniels et al.

(10) Patent No.: US 6,705,583 B2
(45) Date of Patent: Mar. 16, 2004

(54) APPARATUS FOR BUILDING FOUNDATION STEM WALL FORMS

(76) Inventors: Robert Daniels, 2236 Fieldstone Dr., Placerville, CA (US) 95667; Randy Turner, 2236 Fieldstone Dr., Placerville, CA (US) 95667

( * ) Notice: Subject to any disclaimer, the term of this patent is extended or adjusted under 35 U.S.C. 154(b) by 96 days.

(21) Appl. No.: 09/972,627

(22) Filed: Oct. 5, 2001

(65) Prior Publication Data

US 2003/0066943 A1 Apr. 10, 2003

(51) Int. Cl.[7] ..... E04G 13/00; E04G 17/00

(52) U.S. Cl. ..... 249/34; 249/216

(58) Field of Search ..... 249/34, 208, 2, 249/3, 4, 5, 6, 216; 33/518, 645, 613, 624, 625, 651, 651.1, 404, 405, 406, 407, 408, 410; 52/712, 713, 714

(56) References Cited

U.S. PATENT DOCUMENTS 1,700,889 A * 2/1929 Heltzel ..... 249/4
2,298,837 A * 10/1942 Oswald ..... 249/34
2,524,634 A * 10/1950 Oscar ..... 33/404
2,883,759 A * 4/1959 Einbinder et al. ..... 33/645
3,347,514 A * 10/1967 Yates ..... 249/2
4,029,288 A 6/1977 Murphy et al.
4,106,746 A 8/1978 Baculo
4,340,100 A * 7/1982 Anderson, II ..... 33/613
4,635,895 A 1/1987 Johnson et al.
5,174,083 A * 12/1992 Mussell ..... 249/5
6,513,286 B2 * 2/2003 Vierra ..... 33/406

* cited by examiner

*Primary Examiner*—Michael Safavi
(74) *Attorney, Agent, or Firm*—John P. Costello

(57) ABSTRACT

An apparatus for building stem wall forms which can be easily deployed by a form laborer to set up stem wall forms at a building site. The apparatus is collapsible for easy deployment and removal from a stem wall form. The preferred embodiment is comprised of a collapsible rectangular center structure coupled to a board holder and a board support arranged in diagonal relation to each other. The board holder allows the apparatus to hang from a first form board and the board support allows a second form board to rest thereon. In use, the apparatus functions by holding opposing form boards of a stem wall form in a parallel relation to each other, so that the form boards can be staked and nailed into place. Once the form boards are staked in place, to create a stem wall form, the apparatus can be collapsed, and removed from the form to be reused again at another location.

12 Claims, 6 Drawing Sheets

APPARATUS FOR BUILDING FOUNDATION STEM WALL FORMS

TECHNICAL FIELD

This invention relates to the field of building construction, and more specifically, relates to constructing foundation stem wall forms.

BACKGROUND

Foundations for housing structures are surrounded by a stem wall, which is a small perimeter concrete wall, usually between six and ten inches tall, upon which the perimeter of the house sits. This stem wall elevates the wooden structural members of a house, above the surrounding earth, so as to avoid standing water, rot and the like. In pouring a foundation and its associated stem wall, it is most desirable that the concrete pour be done continuously, so that there are no seams between the footing and stem wall to serve as an opportunity for water to seep through and cause damage. The set up of the stem wall portion of the continuous pour forms usually requires up to three laborers to properly space and elevate the form boards and then stake them into place. This process is time consuming and labor intensive.

Therefore, a needs exists for an apparatus which allows for the fast set up of stem wall forms with minimal labor requirements.

SUMMARY OF THE INVENTION

The inventive apparatus for building stem wall forms can be easily deployed by a single laborer to set up the stem wall forms at a building site. The apparatus is collapsible for easy deployment and removal from a stem wall form. In use, the apparatus functions by holding opposing form boards of a stem wall form in parallel alignment, so that the form boards can be staked and nailed into place. Once the form boards are staked in place to create a stem wall form, the apparatus can be collapsed, and removed from the form to be reused again at another location.

In the preferred embodiment, the apparatus is comprised of a center structure that is collapsible, and is coupled to a board holder for holding a one board side of a stem wall form in precise parallel alignment with an opposite board side of the stem wall form. Once aligned in a parallel orientation, the form boards are nailed to stakes, in the conventional way, and the form is complete. Preferably, for a typical form, (e.g. with a 2"×10" form board having any standard length), a form laborer would deploy two to three of the apparatus along this length to set up a section of stem wall form.

When a section of form is set up, the worker needs only to collapse the apparatus and move to the next section of stem wall form and reuse the apparatus at that location. Accordingly, the following objects and advantages of the invention apply:

It is an object of this invention to provide an apparatus for more efficiently setting up a stem wall form.

It is another object of this invention to provide an apparatus for saving on labor costs required to set up a stem wall form.

It is a final object of this invention to provide an apparatus for setting up a stem wall form that is easily removable from a stem wall form, following set up, and which can be reused.

Further objects and advantages of the invention will be brought out in the following portions of the specification, wherein the detailed description is for the purpose of fully disclosing preferred embodiments of the invention, without placing limitations thereon.

BRIEF DESCRIPTION OF THE DRAWINGS

The invention will be more fully understood by reference to the following drawings which are for illustrative purposes only.

DETAILED DESCRIPTION OF THE PREFERRED EMBODIMENTS

Figure 1:
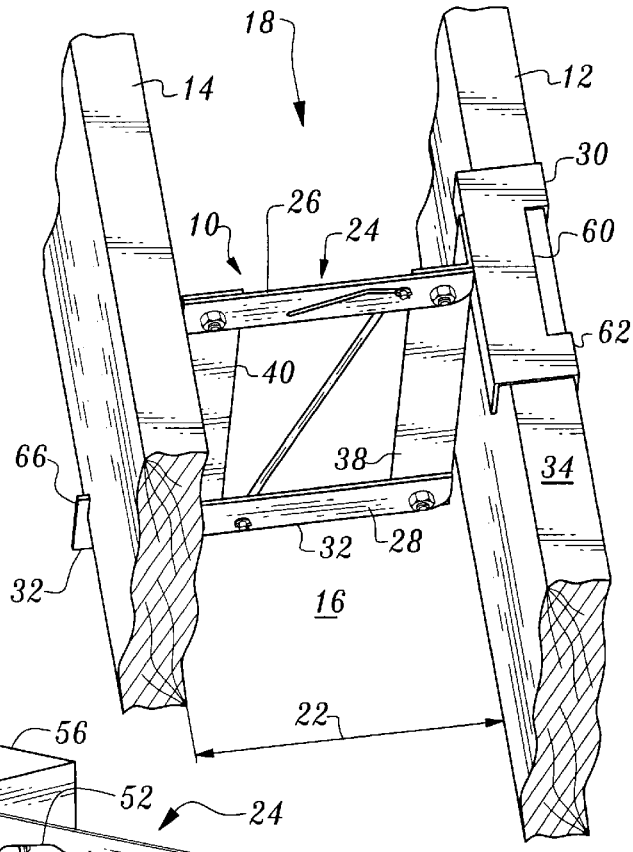
FIG. 1 is an elevated perspective view of the inventive apparatus deployed within a stem wall foundation form.

Referring to FIG. 1, the preferred embodiment of the inventive apparatus 10 is shown deployed for purposes of constructing a foundation stem wall form 18. Stem wall form 18 is formed atop footer well 16. The opposing form boards 12, 14 of stem wall form 18 are shown being held by the inventive apparatus 10 in a precise parallel orientation to each other. The typical horizontal distance between the inside of the form boards (arrows 22) is either 6" or 8"

depending on the height of the structure being built. The apparatus 10 is used to spacially support form boards 12, 14 a similar horizontal distance, and therefore, center structure 24, is approximately 6" to 8" at its widest point along its horizontal sides 26, 28, to provide the proper spacing for form boards 12, 14. Board holder 30 and board support 32 are coupled to center structure 24 in a substantially diagonal relation so that board holder 30 engages the top portion 34 of a first form board 12 and board support 32 engages and supports second form board 14 at its bottom portion. Board holder 30 and board support 32 extend outward from the vertical sides 38, 40 of center structure 24 so as to capture the opposing form boards 12,14, with center structure 24 supplying the appropriate spacing between the boards 12, 14 in a manner further described below.

Figure 2:
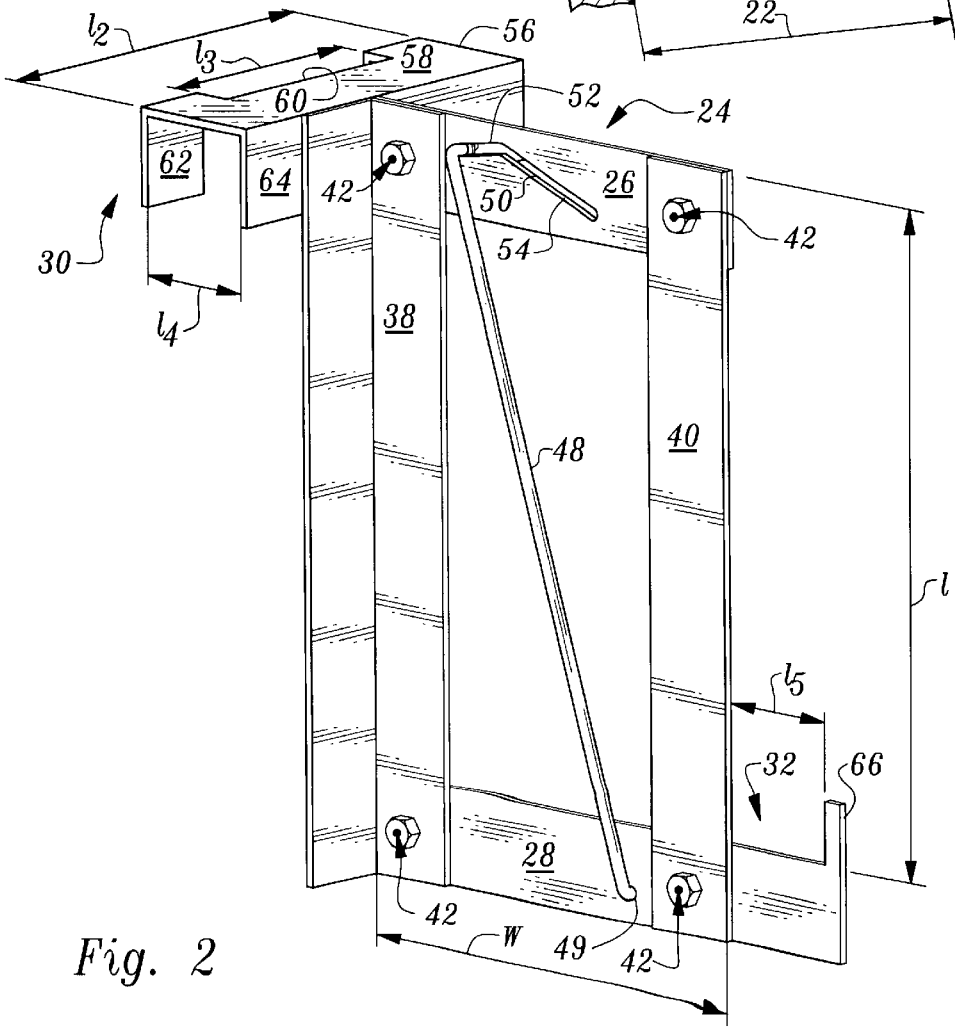
FIG. 2 is a perspective view of the inventive apparatus shown in a deployed state.
Figure 3:
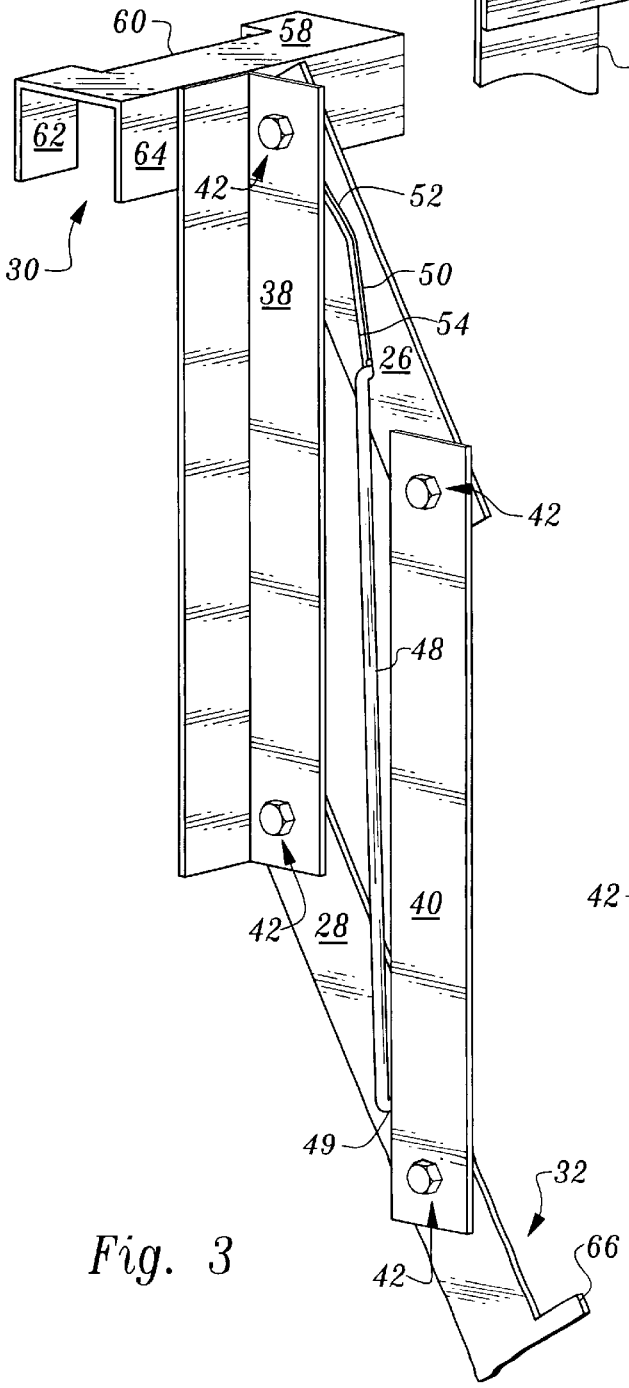
FIG. 3 is a perspective view of the inventive apparatus shown in a collapsed state.
Figure 4:
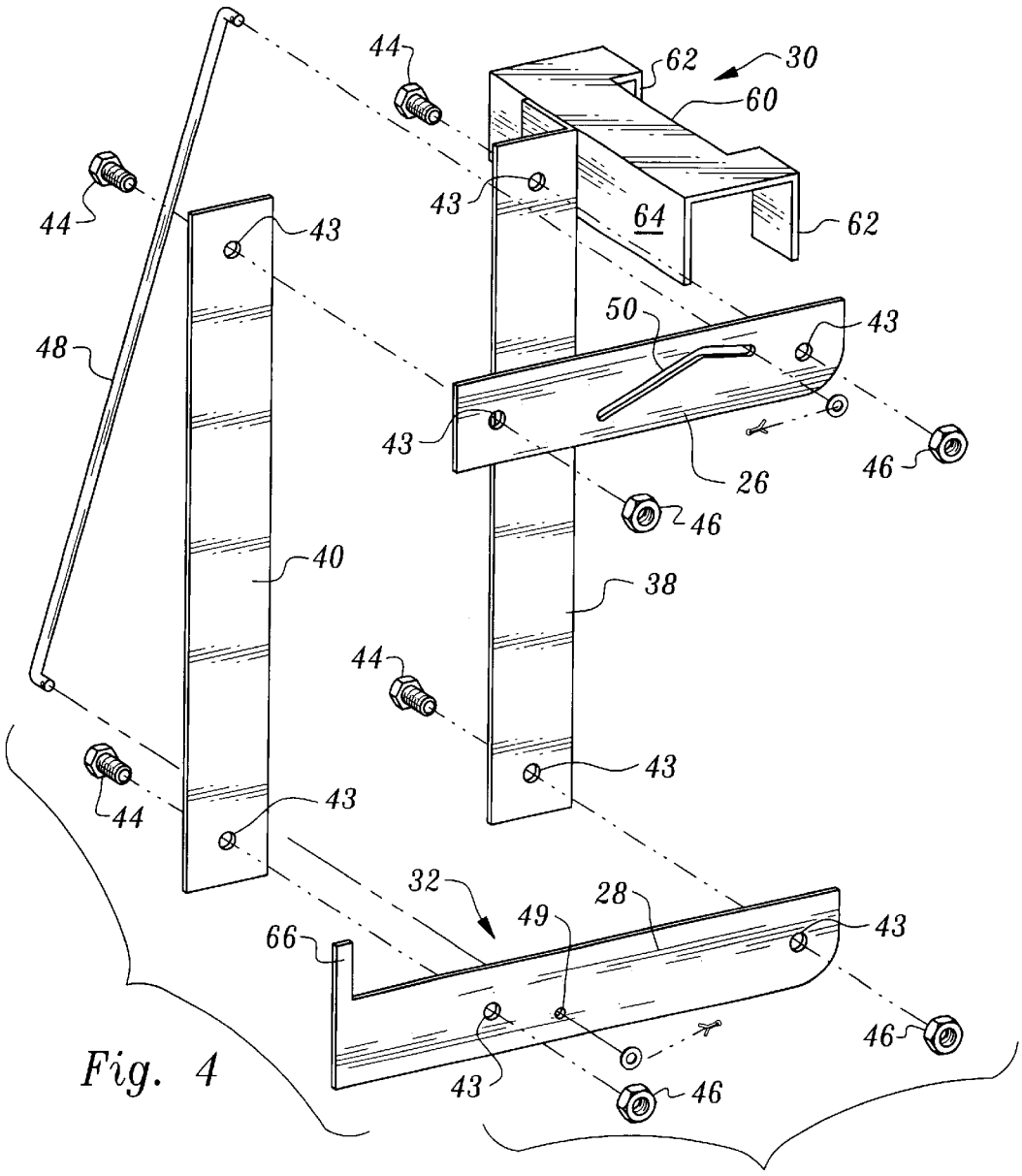
FIG. 4 is an exploded perspective view of the inventive apparatus.

Referring also to FIG. 2, center structure 24 is preferably a rectangle having left and right vertical sides 38, 40 and top and bottom horizontal sides 26, 28. Board holder 30, is located at a top corner of the rectangle and board support 32 is located at a bottom corner. Center structure is preferably 6" to 8" along its width w, corresponding with the inside horizontal distance between form boards 12, 14 of form well 16 as shown by arrows 22. The distance l from the top of board support 32 to the top of upper horizontal side 26, is preferably between 9" to 10" to accommodate 2×10 form boards which are commonly used in form building. Center structure further includes four pivot points 42 located at each of the its four corners, these pivot points allowing center structure to progress from a fully deployed position as shown in FIG. 2 to a collapsed position as shown in FIG. 3. Pivot points 42 are accomplished by imparting holes 43 through sides 26, 28, 38, 40 and placing bolts 44 in said holes and anchoring with nylon threaded stop-nuts 46, as shown in FIG. 4.

Figure 5A:
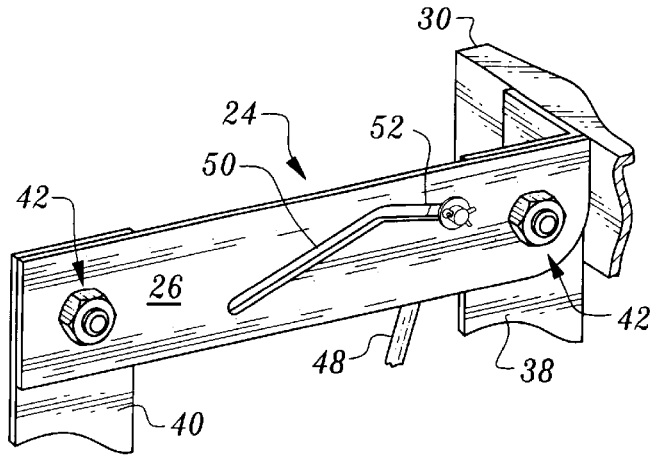
FIG. 5A is a closeup front view of the end of rod support engaging the deployed position of the slot element of the inventive apparatus.

Referring again to FIGS. 2 and 3, apparatus 10 can alternate between a deployed and a collapsed state. This alternating state between deployment and collapse is made possible by rod support 48. Rod support 48 is pivotally coupled 49 to lower horizontal side 28, this pivotal coupling allowing rod support 48 to alternate between a first deployed position and a second collapsed position. Upper horizontal side 26 includes slot 50 which has a first deployed position 52 and a second collapsed position 54 between which the opposite end of rod support 48 alternates. As further shown in FIG. 5A the first deployed position 52 of slot 50 causes center structure 24 to lock in a deployed state with rod support 48 lying substantially diagonal on center structure 24. This deployment causes center structure 24 to become rigid, against which form boards 12, 14 can lean and be supported against. As further shown in FIG. 5B placing rod support 48 in the second collapsed position 54 of slot 50, causes center structure 24 to collapse. Upon rod support 48 collapsing, pivot points 42 cause sides 26, 28, 38, 40 to pivot and collapse, which in turn causes board support 32 to pivot away from the underside of form board 14, in a manner further described below.

Figure 6:
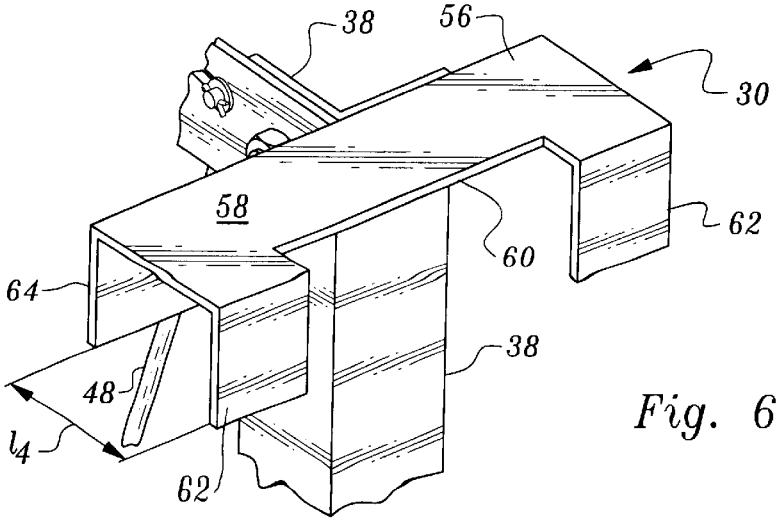
FIG. 6 is a closeup perspective view of the board holder element of the inventive apparatus.
Figure 7:
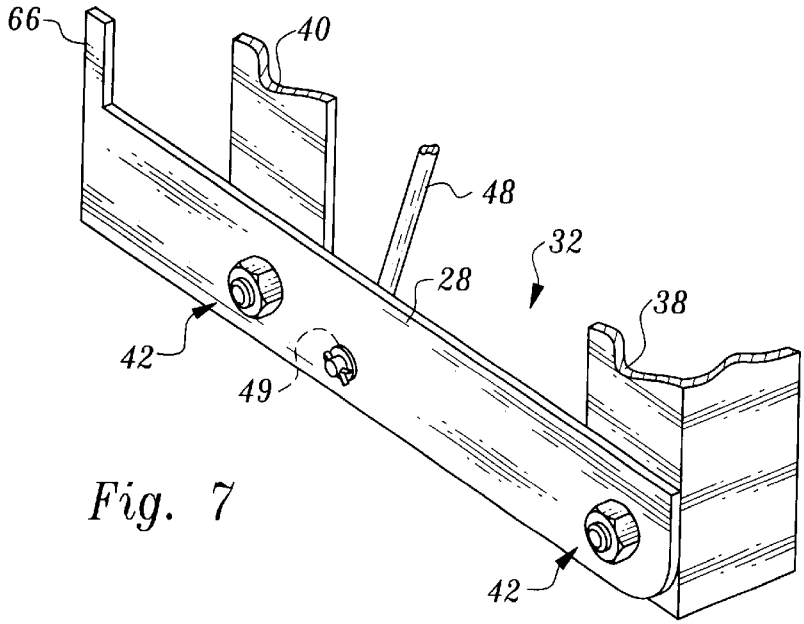
FIG. 7 is a closeup perspective view of the board support element of the inventive apparatus.
Figure 8:
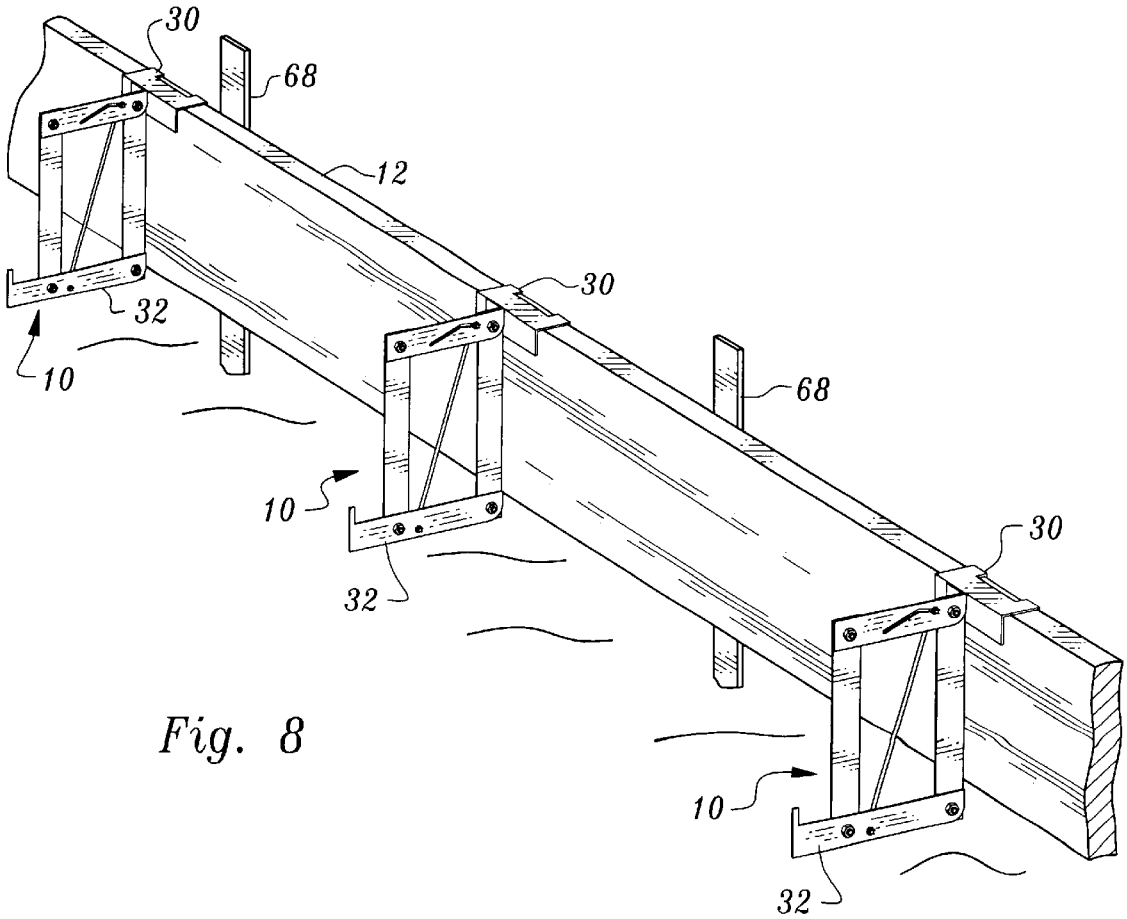
FIG. 8 is a perspective view of a preferred arrangement of three of the inventive apparatus being used to set up a section of a stem wall foundation form, this view showing the apparatus suspended from a first form board, with the second form board yet to be placed on the apparatus.
Figure 9:
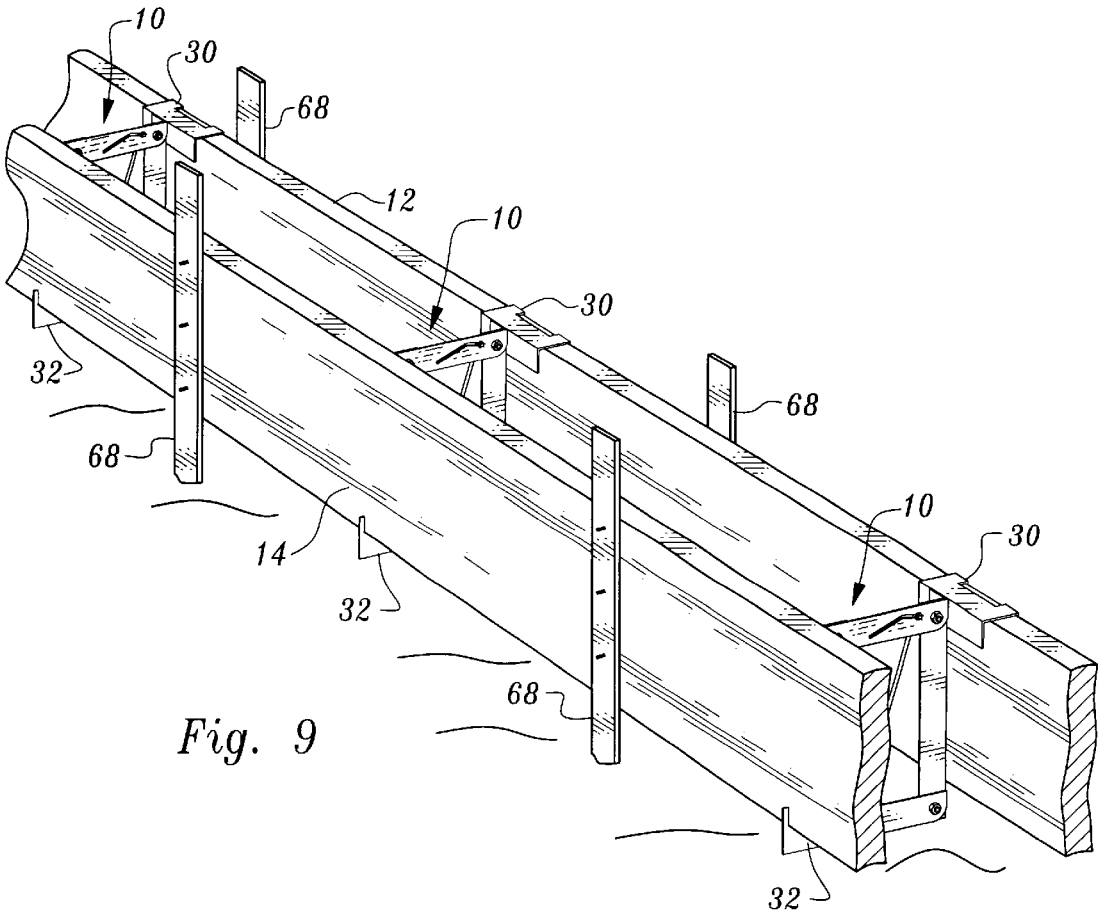
FIG. 9 is a perspective view of a preferred arrangement of three of the inventive apparatus being used to set up a section of a stem wall foundation form, this view showing the apparatus having received the second form board which is shown nailed to foundation stakes as a final step in setting up the form section.

Referring also to FIGS. 6 and 7, board holder 30 and board support 32 can be examined. Form boards 12,14 are held in a vertical position against sides 38, 40 of the deployed center structure 24 by board holder 30 and board support 32. As seen in FIG. 6 and FIG. 2, board holder 30 preferably comprises an elongate member 56 of approximately 4" to 6" long along length l-2, having a top surface 58 with a cutout 60 located therein. Elongate member 56 is oriented perpendicular to horizontal side 38. Cutout 60 has a length l-3 of approximately 2¾" and provides a window exposing form board material so that a stake can be nailed to form board 12 and anchor the apparatus 10 in place, if desired, thereby preventing apparatus from traveling. Protruding downward at right angles to top surface 58 are tabs 62 and side 64. The distance l-4 between tabs 62 and side 64 is preferably 1 9/16", the current standard board width of a 2×10 board. However this distance can be wider to accommodate non-conventional board widths as well. Tabs 62 and side 64, along with top surface 58 form an overlapping three-sided structure at each end of board holder 30. This three sided structure allows the apparatus 10 to be hung from a form board that is already staked in place as shown in FIG. 8. The three sided structure of board holder 30 overlaps form board 12 and the downward pressure caused by the hanging weight of apparatus 10 holds board holder 30 against form board 12. Subsequently, a second form board 14 can be supported upon board support 32 and nailed to stakes, as shown in FIGS. 1 and 9. The distance l-5 on board support is preferably 1 9/16" or wider. A board stop 66 protrudes slightly above board support 32 to prevent the second form board 14 from laterally sliding off of board support.

In a preferred set up arrangement as shown in FIGS. 8–9 three copies of the apparatus 10 are used along a form section. As shown in FIG. 8, three samples of apparatus 10 are set via board holder 30 along a first form board 12 previously staked 68 into place. At this point, each apparatus 10 is locked into a deployed condition with rod support 48. Next, as seen in FIG. 9 a second form board 14 is placed, this form board 14 lining up on each board support 32 of each apparatus 10. Board stop 66 maintains second form board 14 on each board support 32 holding second form board 14 tightly against vertical side 40. Second form board 14 is next nailed to stakes 68 set alongside second form board 14.

Figure 10:
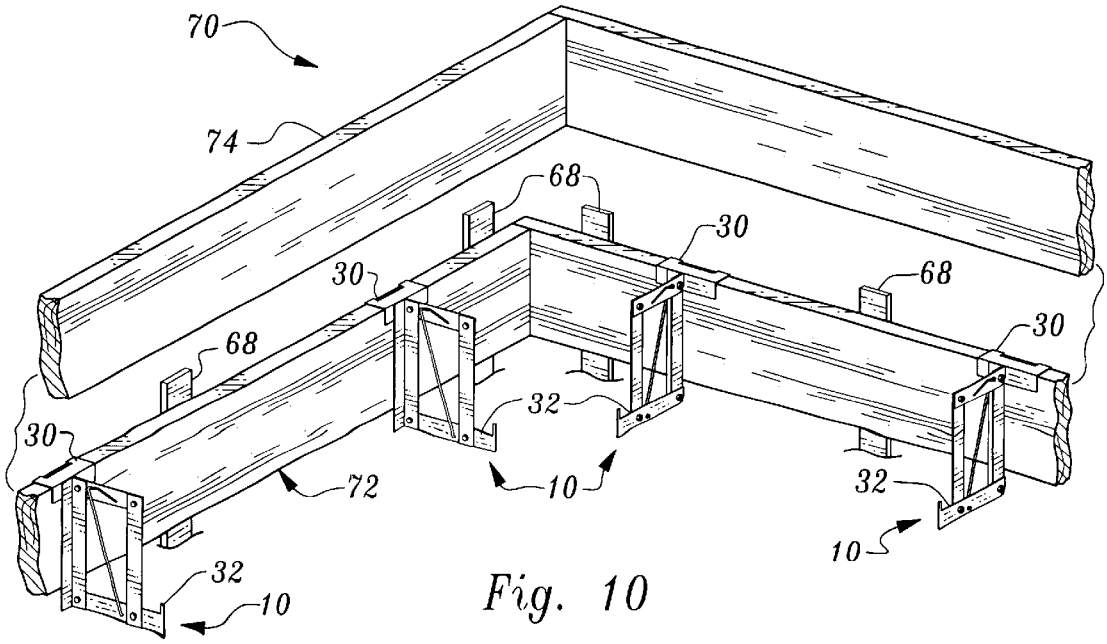
FIG. 10 is a perspective view of a preferred arrangement of the inventive apparatus being used to set up a corner section of a stem wall foundation form, this view showing the apparatus suspended from a first side of the corner section, with the second side yet to be placed on the apparatus.
Figure 11:
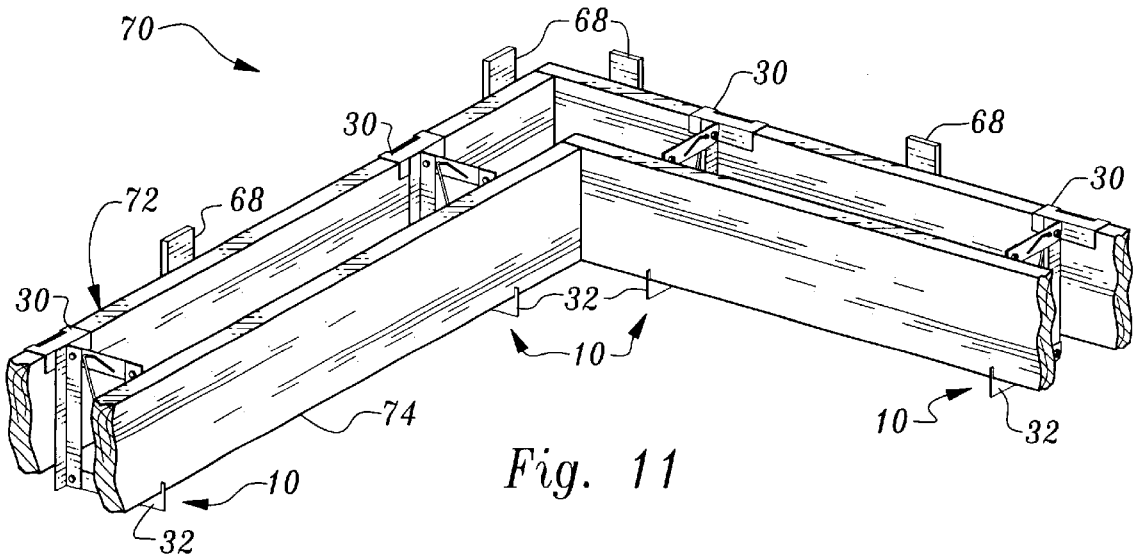
FIG. 11 is a perspective view of a preferred arrangement of the inventive apparatus being used to set up a corner section of a stem wall foundation form, this view showing the apparatus having received the second side of the corner section, which is shown nailed to foundation stakes as a final step in setting up the form corner section.

FIGS. 10–11 illustrates the setup of a corner section 70 of a stem wall foundation form. An outside corner 72 can be constructed and staked in place. A number of the apparatus 10 can then be hung from the outside corner 72 via board holder 30. An inside corner 74 can then be constructed and placed upon the board supports 32 of apparatus 10 and nailed to stakes, to finish out the corner section 70.

Figure 5B:
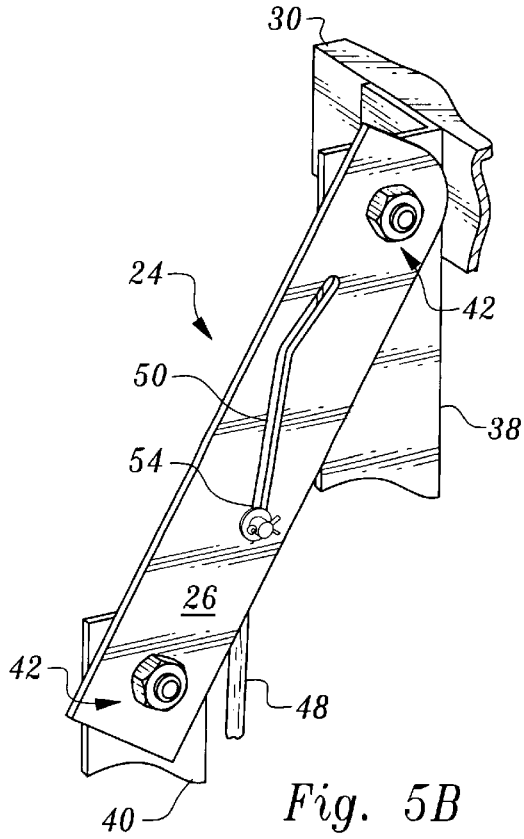
FIG. 5B is a closeup front view of the end of rod support engaging the collapsed position of the slot element of the inventive apparatus.
Figure 12:
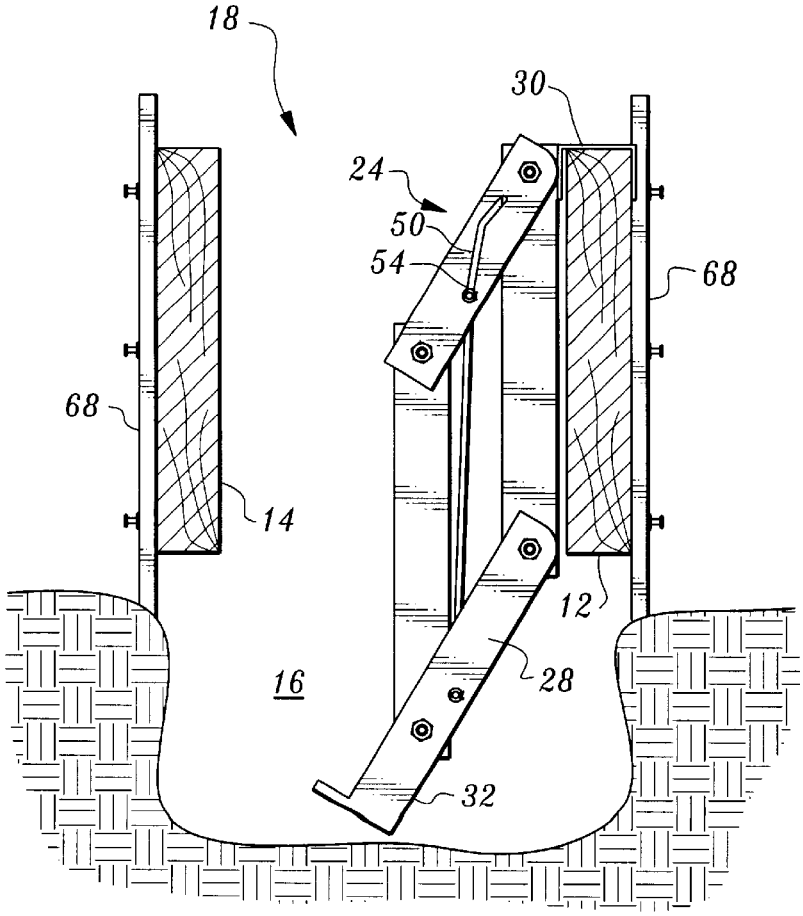
FIG. 12 is a frontal view of the inventive apparatus shown collapsing inside of a stem wall foundation form with the board support shown pivoting away from the underside of the second form board.

As a final step, apparatus 10 is collapsed and extracted from the completed stem wall form 18. As shown in FIG. 5B rod support 48 is actuated to its second positioning 54 in slot 50 and the center structure 24 goes from a locked, to a collapsed position. FIG. 12 shows board support 32 which is an extension of lower horizontal side 28 pivoting away from the underside of second form board 14, toward the inside of footer well 16. When board support 32 is free from second form board 14, the apparatus 10 can be easily lifted out of the footer well 16 and moved to be reused at a second section of stem wall form 18.

Finally, although the description above contains many specificities, these should not be construed as limiting the scope of the invention but as merely providing illustrations of some of the presently preferred embodiments of this invention. This invention may be altered and rearranged in numerous ways by one skilled in the art without departing from the coverage of any patent claims which are supported by this specification.

What is claimed is:

1. An apparatus for building foundation stem wall forms, the apparatus comprising:

a board holder;

a board support;

a center support structure comprising a rectangle including four pivot points located at each of a corresponding four corners of said rectangle;

an upper horizontal side of said rectangle including a two-position slot, said two position slot engaging a first end of a rod support, said rod support being positioned approximately diagonal on said rectangle when in a deployed state, a second end of said rod support being pivotally coupled to a lower horizontal side of said rectangle;

said rod support engaging a first position of said slot for deploying said rectangle, said rod support engaging a second position of said slot for collapsing said rectangle;

said board support further comprising an extension of a bottom horizontal side of said rectangle, said board support extending outward from a lower corner of said rectangle;

said board holder coupled exteriorly adjacent to an upper corner of said rectangle, said board holder oriented substantially diagonally to said board support.

2. An apparatus for building foundation stem wall forms, said apparatus comprising:

a board holder;

a board support;

said board holder and board support orienting first and second form boards in a parallel relation; and a collapsible center structure having four pivot points, said board holder being substantially diagonally disposed in relation to said board support on said center structure, wherein said center structure collapsibly and pivotally disengages said board support from beneath a form board.

3. An apparatus for building foundation stem wall forms, said apparatus comprising:

a board holder;

a board support;

said board holder being separated a horizontal distance from said board support when said apparatus is fully deployed in a stem wall form; and a collapsible center structure, said board holder being substantially diagonally disposed in relation to said board support on said center structure, wherein said center structure further comprises a rectangle, said rectangle including pivoting corners for pivotally collapsing said rectangle upon itself and causing said board support to disengage from beneath a foundation form board.

4. The apparatus of claim 3, wherein said center structure further comprises a rod movably coupled thereto.

5. The apparatus of claim 4, wherein said rod movably actuates between a first position for supporting said rectangle in a fully deployed state and a second position for allowing said rectangle to collapse.

6. The apparatus of claim 5, wherein said board holder further comprises an elongate member connected near an upper corner of said rectangle, said elongate member extending outward from a vertical side of said rectangle.

7. The apparatus of claim 6, wherein said elongate member is further connected perpendicularly in relation to said vertical side of said rectangle.

8. The apparatus of claim 7, wherein said elongate member further comprises a top surface, a side and a tab, said side and tab both protruding downward at a right angle from said top surface, thereby forming a three sided structure for capturing and holding a top portion of a form board.

9. The apparatus of claim 8, wherein said three sided structure is coupled at both ends of said elongate member, said three sided structures being separated by a cutout.

10. The apparatus of claim 9, wherein said cutout is between 2 and 3 inches in length.

11. An apparatus for building foundation stem wall forms, the apparatus comprising:

holding means for holding a form board;

support means for supporting an opposite form board than that of said holding means, said form boards being held by said holding means and said support means in a parallel orientation to each other;

a collapsible center structure, said holding means being substantially diagonally disposed in relation to said support means on said center structure, wherein said center structure further comprises a rectangle, said rectangle including pivoting corners for pivotally collapsing said rectangle upon itself and causing said support means to disengage from beneath a form board.

12. The apparatus of claim 11, further comprising means for alternately maintaining said rectangle in a deployed state or a collapsed state.

* * * * *